US005453724A

United States Patent [19]

Seymour et al.

[11] Patent Number: 5,453,724

[45] Date of Patent: Sep. 26, 1995

[54] FLUX SHIFTER ASSEMBLY FOR CIRCUIT BREAKER ACCESSORIES

[75] Inventors: Raymond K. Seymour, Plainville; Michael C. Guerrette, Bristol, both of Conn.

[73] Assignee: General Electric, Schenectady, N.Y.

[21] Appl. No.: 250,232

[22] Filed: May 27, 1994

[51] Int. Cl.[6] ..... H01H 9/00

[52] U.S. Cl. ..... 335/172; 335/177; 335/179

[58] Field of Search ..... 335/167–176, 335/177, 178, 179

[56] References Cited

U.S. PATENT DOCUMENTS 3,693,122 9/1972 Willard .

4,833,563 5/1989 Russell .

*Primary Examiner*—Lincoln Donovan

*Attorney, Agent, or Firm*—Richard A. Menelly

[57] ABSTRACT

A flux shifter unit with increased magnetic susceptibility for use with a combined bell alarm and lock-out accessory is connected with the electronic trip unit that controls a high ampere rated circuit breaker. The flux shifter unit is configured to eliminate nuisance tripping due to the vibration of the associated electrical equipment.

7 Claims, 3 Drawing Sheets

FLUX SHIFTER ASSEMBLY FOR CIRCUIT BREAKER ACCESSORIES

BACKGROUND OF THE INVENTION

U.S. Pat. No. 3,693,122 entitled "Flux Transfer Trip Device for Electric Circuit Breakers" describes a flux shifter unit that interacts with the circuit breaker operating mechanism to separate the circuit breaker contacts upon occurrence of an overcurrent condition within a protected electrical distribution system. A flux diverter element interfaces between the holding magnet and the powerful driving spring to insure immediate response to a flux cancelling electrical signal.

The flux shifter described within U.S. Pat. No. 4,251,789 is smaller in size and requires a lower energy flux cancelling electrical signal. The smaller associated holding magnet and driving spring are used to release a small-sized target to indicate the occurrence of an overcurrent interruption function.

U.S. Patent application Ser. No. 08/248,910, filed May 25, 1994 entitled "Combined Bell Alarm and Lock-out Accessory" describes a circuit breaker accessory that can be installed within the circuit breaker cover as one of a plurality of selectable circuit breaker accessory functions.

When the accessory is contained within the circuit breaker compartment within an industrial environment, the vibrations associated with certain manufacturing processes are too intense to allow the use of small flux shifter devices as disclosed within the aforementioned U.S. Pat. No. 4,251,789 without causing the flux shifter to release from the holding magnet.

The large electrical signal required to release the flux shifter disclosed within the aforementioned U.S. Pat. No. 3,693,122 is not available when the accessory device is used with and electronic trip unit due to the requirement that the flux shifter be released after the source of energy to the trip unit is interrupted.

One purpose of the invention is to provide a smaller sized flux shifter unit that is releasable by means of a small pulse electrical signal and is immune to the impact and vibratory forces associated within an industrial environment.

SUMMARY OF THE INVENTION

A flux shifter unit used within a circuit breaker accessory unit employs a holding magnet to retain the armature against the propelling bias of a powerful extension spring. The magnetic diverter unit that interfaces the end of the armature and the holding magnet is conically recessed to receive the cone-shaped armature end. The conical configuration controls the magnetic gap between the magnetic diverter and the end of the armature to provide a gradual decrease in the magnetic holding forces as the armature recedes from the magnetic diverter.

BRIEF DESCRIPTION OF THE DRAWINGS

FIG. 6 is graphic representation of the magnetic attraction forces as a function of the separation distance between the magnetic diverter and the armature within the flux shifter of FIG. 2.

DESCRIPTION OF THE PREFERRED EMBODIMENT

Figure 1:
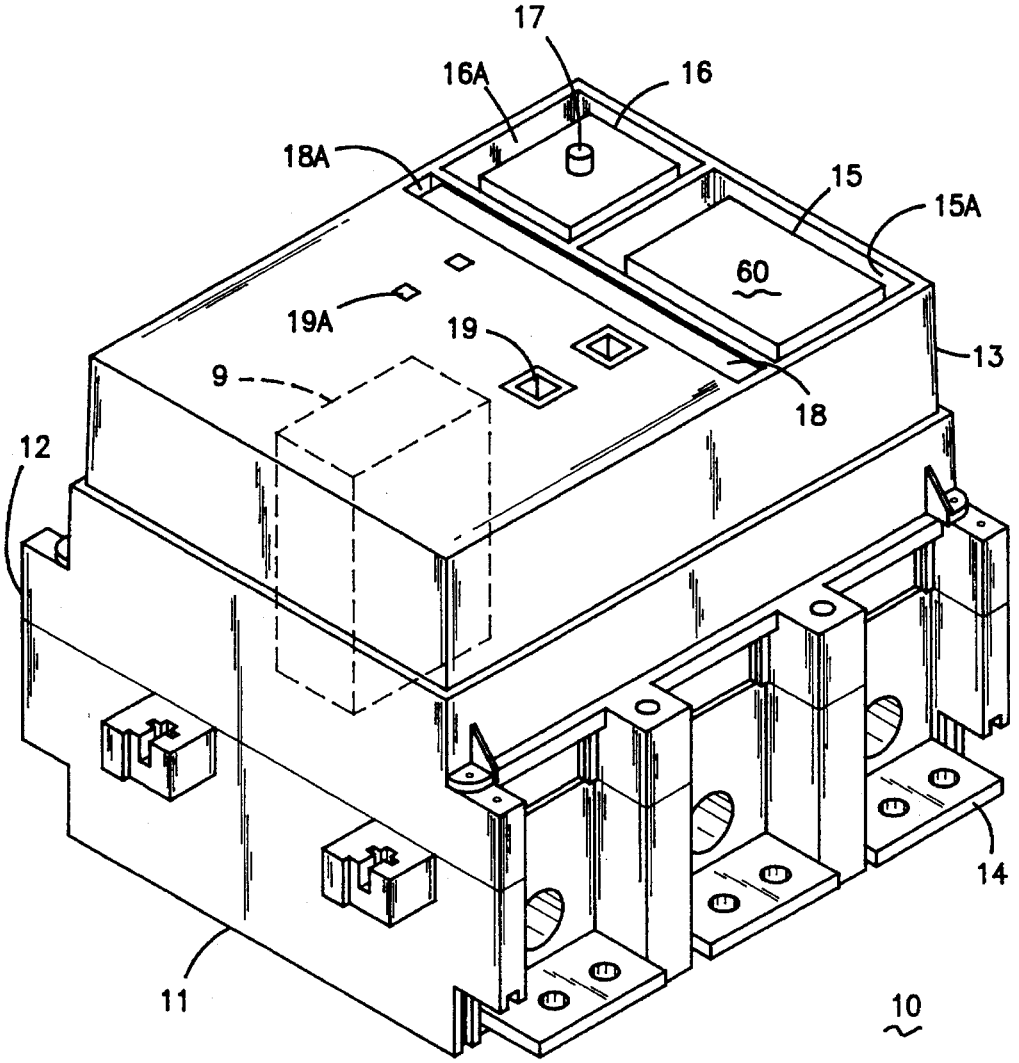
FIG. 1 is a top perspective view of a high ampere rated circuit breaker employing a combined bell alarm and lock-out accessory.

The high ampere-rated circuit breaker 10 shown in FIG. 1 is described in U.S. Patent application Ser. No. 08/202,140, filed Feb. 25, 1994 entitled "Operating Mechanism for High Ampere-rated Circuit Breakers" and is capable of transferring several thousand amperes quiescent circuit current at several hundred volts potential without overheating. The circuit breaker consists of an electrically insulated base 11 to which an intermediate cover 12 of similar insulative material is attached prior to attaching the top cover 13, also consisting of an electrically-insulative material. The operating mechanism 9 as described within the aforementioned U.S. Patent application Ser. No. 08/202,140, filed Feb. 25, 1994 controls the condition of the circuit breaker contacts. Electrical connection with the interior current-carrying components is made by load terminal straps 14 extending from one side of the base and line terminal straps (not shown) extending from the opposite side thereof. The interior components are controlled by an electronic trip unit 15 contained within a recess 15A on the top surface of the top cover 13. The trip unit is similar to that described within U.S. Pat. No. 4,672,501 and interacts further with the combined bell alarm and lock-out accessory 16 contained within the accessory recess 16A. The reset button 17 extending from the top of the bell alarm and lock-out accessory serves to provide reset function to the accessory as well as indication as to whether the circuit breaker operating mechanism is operative. ON and OFF buttons 19 and indicators 19A accessible from the top cover allow manual operation of the circuit breaker operating mechanism to separate the circuit breaker contacts. An operating handle 18 within the handle recess 18A allows the circuit breaker operating mechanism to be manually reset after automatic separation of the circuit breaker contacts. The reset button 17 on the top surface of the bell alarm and lock-out accessory 16 allows the accessory to be reset if the accessory is not in a lock-out mode as will be described below.

Figure 2:
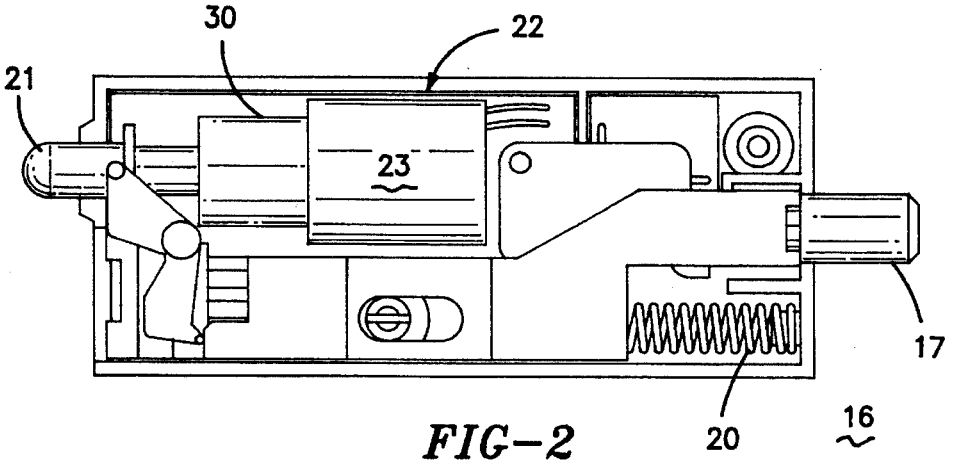
FIG. 2 is an enlarged side view of the flux shifter within the accessory of FIG. 1.

The components within the bell alarm and lock-out accessory 16 are depicted in FIG. 2 and mainly consist of the flux shifter 22 which governs the position of the plunger cap 21 and the reset button 17 arranged at opposite ends thereof. The guide cover 30, coil 23 and return spring 20 function in the manner described within the aforementioned U.S. Patent application Ser. No. 08/248,910, filed May 25, 1994 entitled "Combined Bell Alarm and Lock-out Accessory".

Figure 3:
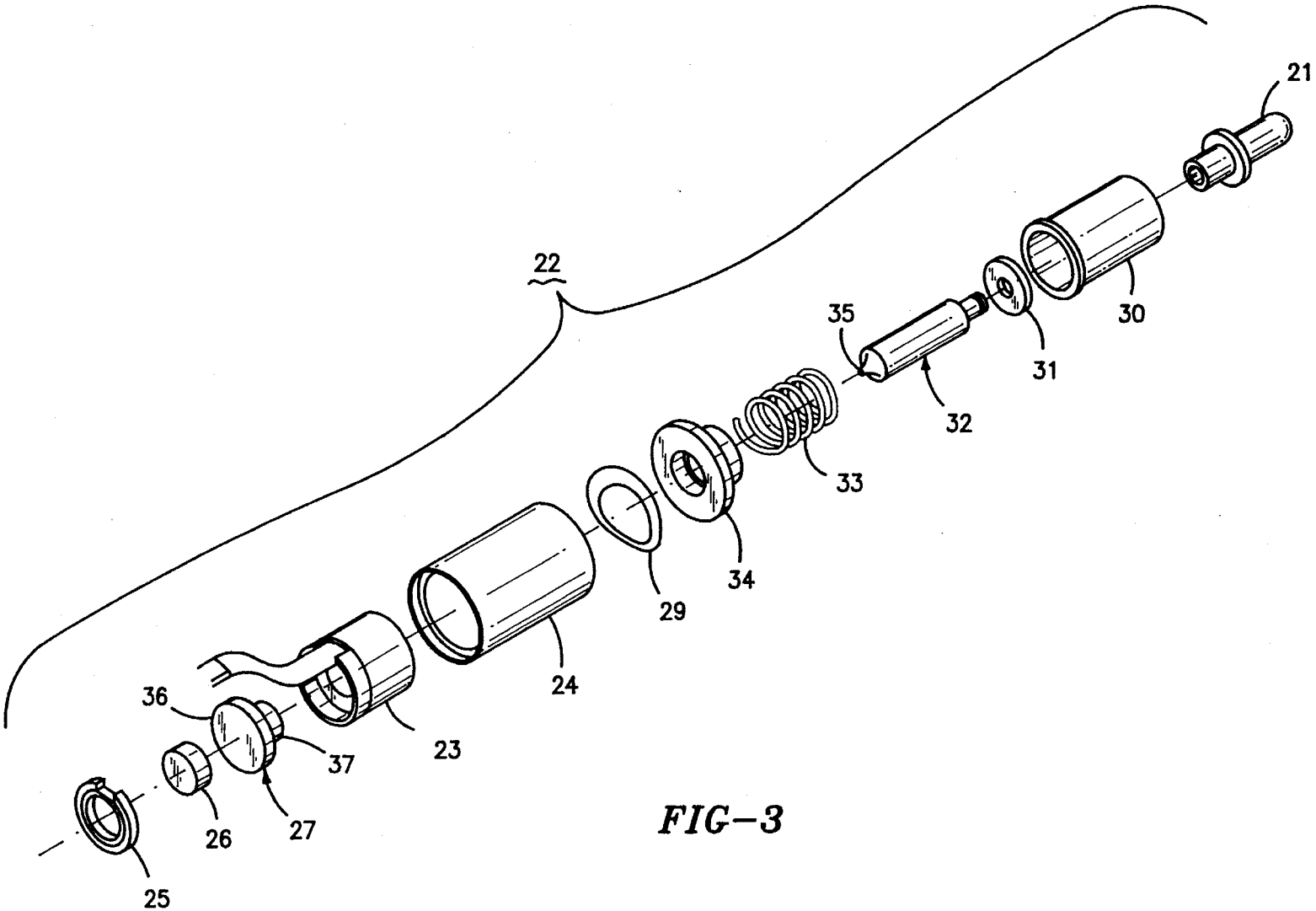
FIG. 3 is a top perspective view of components used within the flux shifter of FIG. 2.
Figure 4:
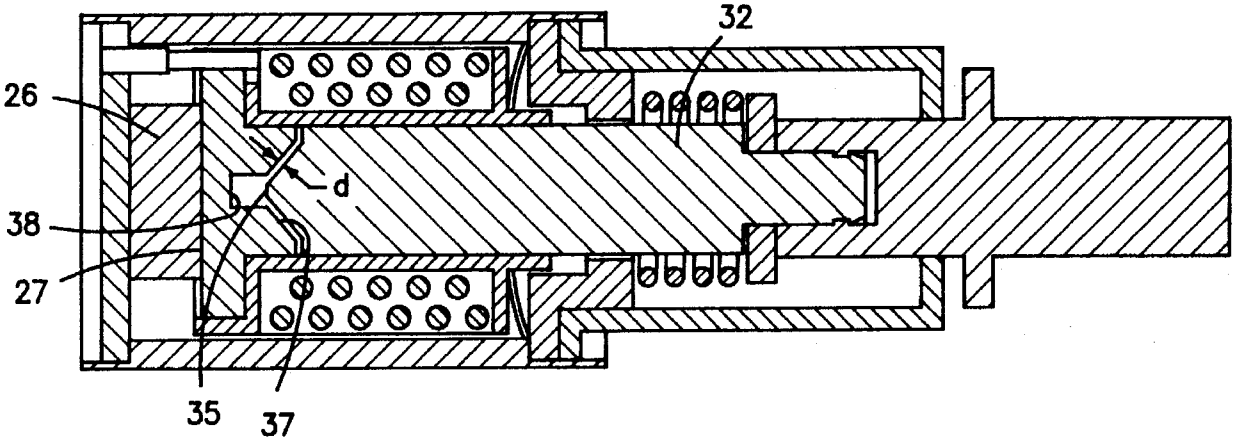
FIGS. 4 and 5 are enlarged sectional views of the flux shifter of FIG. 2.
Figure 5:
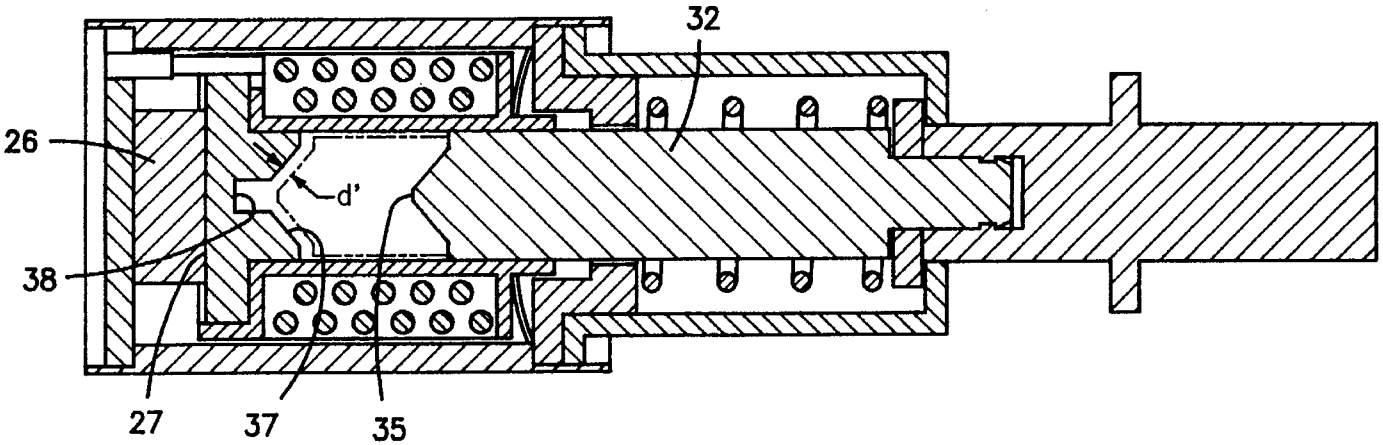

The components of the flux shifter 22 are shown in FIG. 3 prior to assembly within the steel housing 24 and the plastic guide cover 30. The end plate 25 supports the holding magnet 26, diverter 27 and release coil 23 within the housing 24. The plunger 32 fits and extends through the washer 31 within the cover 30 and the plunger cap 21 at one end and through the spring 33, front cover 34, washer 29 within the housing at the opposite end. In accordance with the teachings of the invention, the flux shifter is made "vibration-proof" whereby the flux shifter is subjected to vibration and impact without releasing the armature from the holding magnet by the provision of the conical end 35 on the end of the armature 32. The diverter 27 defines a circular base 36 with a pedestal 37 formed on one side. The pedestal 37 on the diverter includes a complimentary funnel-shaped slot 38 shown in FIG. 4 which receives the conical end 35 formed on the plunger 32 to set the gap d between the diverter and the plunger. The gap determines the holding force provided by the magnet 26 on the plunger through the diverter to hold the plunger 32 again to the position shown in FIG. 5. Before describing the interim gap d' shown in FIG. 5, it is helpful to review the magnetic gradient curves 39, 40 shown in FIG. 6 that represent a planar ended diverter and plunger as described in the aforementioned U.S Patents and the conical ended diverter and plunger according to the invention respectively. The magnetic gradient 39 is shown to rapidly decrease in magnetic force B as the gap between the diverter and magnet increases. The magnetic gradient 40 is shown to decrease at a lesser rate. As the plunger is displaced slightly from the diverter, by shock or vibration, the magnet force of attraction decreases rapidly as the gap increases. With the larger forces generated between the holding magnet and diverter used within the flux shifter described within the aforementioned U.S. Pat. No. 3,693,122, the decreased magnetic force is amply sufficient to hold the diverter against the magnet and prevent the plunger from extending under the opposing spring bias. The conical configuration of the invention allows the diverter to become displaced a greater distance before the magnetic force drops to a low enough value to release the plunger. The graded conical surfaces insure that a minimum gap is maintained until the conical end 35 completely clears the edges of the funnel shaped slot 38.

A flux shifter has been described as having a plunger shaped for gradual rather than abrubt release from the holding magnet therein. The provision of the shaped surfaces renders the flux shifter immune to release of the plunger due to vibration or impact.

We claim:

1. An industrial-rated circuit breaker for high level overcurrent protection comprising:

an insulative base and an insulative cover;

an operating mechanism in said base controlled by an electronic trip unit arranged within a trip unit recess in said cover to interrupt circuit current upon occurrence of an overcurrent condition within a protected circuit;

an accessory unit including a flux shifter arranged within an accessory recess in said cover, and a plunger extending from said accessory unit at a bottom thereof to prevent said operating mechanism from being reset after said circuit interruption;

a magnet at one end of said flux shifter holding said plunger against the urgency of a compression spring;

a magnetic flux diverter defining a circular base and a circular pedestal on said base intermediate said plunger and said magnet, said diverter comprising a circular base and a circular pedestal on said base, said circular base including a shaped slot formed therein, said plunger including a complimentary shaped end received within said slot for holding said plunger against said diverter, said shaped end having a conical configuration.

2. The industrial-rated circuit breaker of claim 1 including a release coil 23 surrounding a part of said diverter and a part of said plunger for generating an opposing magnetic flux to said magnet.

3. A circuit breaker accessory unit comprising:

a flux shifter a flux shifter intermediate a plunger and a reset button for interacting with a circuit breaker operating mechanism and preventing said operating mechanism from becoming reset after a circuit interruption without manual intervention; bias means driving said reset button to an extended trip indicating position upon occurrence of said circuit interruption; and a magnet at one end of said flux shifter holding said plunger against the urgency of a compression spring; and a magnetic diverter intermediate said plunger and said magnet, said diverter defining a circular base and a circular pedestal on said base, said circular pedestal including a funnel-shaped slot.

4. The circuit breaker accessory unit of claim 3 including a release coil 23 surrounding a part of said diverter and a part of said plunger for generating an opposing magnetic flux to said magnet.

5. A circuit breaker flux shifter unit comprising:

a metal housing;

permanent magnet and a flux diverter within said housing, said diverter defining a circular base having a first diameter and a circular pedestal having a second diameter smaller than said first diameter, said pedestal defining a funnel-shaped slot; a release coil in said housing, said release coil surrounding a part of said flux diverter;

a non-metallic guide cover arranged at one end of said housing;

a metallic plunger extending within said guide cover and being biased for movement in a predetermined direction by means of a compression spring, said plunger being shaped at one end for optimum magnetic force transfer between said plunger end and said diverter.

6. The circuit breaker flux shifter unit of claim 5 wherein said flux shifter end is received within said funnel-shaped slot.

7. The circuit breaker flux shifter unit of 5 including a non-metallic plunger cap, said plunger being received within said plunger cap whereby said plunger cap becomes extended in said predetermined direction upon said movement of said plunger.

* * * * *